US005245356A

United States Patent [19]

Ota et al.

[11] Patent Number: 5,245,356

[45] Date of Patent: Sep. 14, 1993

[54] THERMAL PRINTING HEAD

[75] Inventors: Shigeo Ota, Nakamura; Tsutomu; Masato Sakai; Mineo Nishikawa; Masayoshi Yamaguchi; Takaya Nagahata, all of Kyoto, Japan

[73] Assignee: Rohm Co., Ltd., Kyoto, Japan

[21] Appl. No.: 896,979

[22] Filed: Jun. 11, 1992

Related U.S. Application Data

[63] Continuation-in-part of Ser. No. 754,589, Sep. 4, 1991, abandoned.

[30] Foreign Application Priority Data

Feb. 19, 1991 [JP] Japan ..... 3-24580
Mar. 6, 1991 [JP] Japan ..... 3-39953
Sep. 3, 1991 [JP] Japan ..... 3-222569

[51] Int. Cl.[5] ..... B41J 2/325
[52] U.S. Cl. ..... 346/76 PH
[58] Field of Search ..... 346/76 PH

[56] References Cited

U.S. PATENT DOCUMENTS

Re. 32,897 3/1989 Salmon .
4,235,555 11/1980 Aprato ..... 346/76 PH
4,259,676 3/1981 Salmon .
4,342,040 7/1982 Fujita .
4,954,839 9/1990 Rogers .
4,963,886 10/1990 Fukuda .

FOREIGN PATENT DOCUMENTS 0014248 8/1980 European Pat. Off. .
0115872 8/1984 European Pat. Off. .
0400615 12/1990 European Pat. Off. .
3940545 6/1990 Fed. Rep. of Germany .
61-132356 6/1986 Japan .
62-284754 12/1987 Japan .
01-78859 3/1989 Japan .
87/00353 1/1987 PCT Int'l Appl. .

OTHER PUBLICATIONS

IBM Technical Disclosure Bulletin vol. 27, No. 18 (Jun. 1984) "Printhead to Driver Card Connection Scheme".
IBM Technical Disclosure Bulletin vol. 23, No. 9 (Feb. 1981) "Removable Printhead Mount".

*Primary Examiner*—Mark J. Reinhart
*Assistant Examiner*—Huan Tran
*Attorney, Agent, or Firm*—William H. Eilberg

[57] ABSTRACT

A thermal printing head comprises a support member, a head circuit board supported on the support member, a connector board overlapped on the head circuit board, and a presser member for pressing the connector board against the head circuit board. The support member is flexible with a modulus of elasticity lying within a range of $1\times10^4-5\times10^5$ kg/mm$^2$. The head circuit board carries a comb-like terminal portion arranged in a limited central portion which is substantially smaller in length than the head circuit board. The connector board also carries a comb-like terminal portion corresponding to the terminal portion of the head circuit board, and the length of the connector board is substantially smaller than that of the head circuit board.

9 Claims, 7 Drawing Sheets

THERMAL PRINTING HEAD

CROSS-REFERENCE TO PRIOR APPLICATION

This is a continuation-in-part of U.S. patent application Ser. No. 07/754,589, filed Sep. 4, 1991, now abandoned.

BACKGROUND OF THE INVENTION

1. Field of the Invention

This invention relates to a thermal printing head which is used for example to print on thermosensitive paper or to cause ink transfer from a thermal transfer ribbon or film onto printing paper. More particularly, the present invention relates to improvements in a thermal printing head of the type wherein a connector board is overlapped on a head circuit board for connection to external circuits.

2. Description of the Prior Art

As is well known, thermal printing heads are widely used in facsimile machines to print transmitted information on thermosensitive paper. The thermal printing head is also used in printers of the type wherein the ink of a transfer ink ribbon or film is thermally caused to be transferred onto printing paper.

There are various type of thermal printing heads which include line-type heads and matrix-type heads. The line-type thermal printing head has a row (line) of multiple heating dots, as disclosed for example in Japanese Patent Application Laid-open No. 63-151466 or No. 63-221055. The matrix-type thermal printing head has a multiplicity of heating dots arranged in a matrix, as disclosed for example in U.S. Pat. No. 3,855,448 to Hanagata et al.

The present invention is directed primarily to the line-type thermal printing head. To clarify the objects of the present invention, reference is now made to FIGS. 10 and 11 which show a typical line-type thermal printing head.

As shown in FIGS. 10 and 11, the prior art thermal printing head comprises an elongate head circuit board 100 adhesively mounted on an elongate support member 101 which is made of aluminum for example to serve also as a heat sink. The head circuit board 100 carries a longitudinal row (line) of multiple heating dots 102 positioned adjacent one longitudinal side of the head circuit board. The head circuit board also carries a comb-like terminal portion 103 located adjacent the other longitudinal side of the circuit board, and an array of drive IC's 104 for selectively driving the heating dots 102. Though not shown, the head circuit board is further formed with a sophisticated conductor pattern.

The printing head further includes a strip-like flexible connector board 105 which is reinforced by a backing 106 made for example of glass-fiber-reinforced resin. In an assembled state, the backing 106 rests directly on the support member 101, as shown in FIG. 11. The flexible board 105 has a front marginal portion projecting beyond the backing 106 to partially overlap the head circuit board 100. The underside of the projecting marginal portion of the flexible board 105 is formed with a comb-like terminal portion 107 in corresponding relation to the terminal portion 103 of the head circuit board 100.

An elongate presser cover 108 is arranged above the connector board 105 and fixed to the support member 101 by means of mounting screws 109 penetrating through the presser member and the connector board into engagement with the support member. The underside of the presser cover is provided with an elastic rod 110 for pressing the comb-like terminal portion 107 of the connector board into intimate contact with the comb-like terminal portion 103 of the head circuit board 100 when the mounting screws 109 are tightened.

In operation of the printer, the heating dot line 102 of the head circuit board 100 is held in intimate contact with thermosensitive paper backed up by a platen 114 (FIG. 11). To enable loading (or re-loading) of thermosensitive paper and/or maintenance of the printing head, one of the printing head and the platen is mounted on a pivotable part of the printer with the other mounted to a fixed part of the printer, so that the printing head and the platen are movable toward and away from each other. Thus, it is necessary to provide a guide means for guiding the platen into a predetermined position relative to the heating dot line 102 when the printing head and the platen are moved toward each other, thereby insuring good printing quality.

The guide means shown in FIGS. 10 and 11 includes a pair of L-shaped platen guides 111 positioned at the respective ends of the support member 101. Each platen guide 111 is formed with a guiding cutout 112 for removably receiving a corresponding shaft end of the platen 114, and fixed to the support member 101 by means of screws 113.

The prior art thermal printing head described above has a serious problem of bending during printing operation. The reason for such bending is as follows.

Generally, the support member (heat sink) 101 and the presser cover 108 are equally made of aluminum because this material is light and yet easily formed into any desired shape. Therefore, these two parts have the same coefficient of linear expansion. However, the support member 101 receives heat immediately from the head circuit board 100, whereas the presser cover 108 receives heat indirectly through the mounting screws 109 with a time lag. Thus, at the time of initiating the actuation of the heating dot line 102 or abruptly changing the actuating voltage, the heat transmitting time lag leads to a difference in the degree of longitudinal expansion between the support member and the presser cover at least before reaching the steady state.

According to the prior art arrangement shown in FIGS. 10 and 11, since the comb-like terminal portion 103 of the head circuit board 100 extends substantially over the entire length of the head circuit board, the flexible connector board 105 and the presser cover 108 must also have a length substantially equal to that of the head circuit board. Further, the entire length of the presser cover 108 must be fixedly mounted to the support member 101 by the mounting screws 109. Thus, when the presser cover and the support member are longitudinally expanded to different degrees, the thermal printing head as a whole bends longitudinally as a result of the so-called "bimetal phenomenon". Also troublesome is the fact that all of the mounting screws 109 must be tightened up in a well controlled manner to insure uniform electrical contact between the two terminal portions 103, 107 over their entire length, consequently prolonging the time required for manufacturing the thermal printing head.

The prior art thermal printing head has another problem with respect to the platen guides 111. Specifically, each platen guide 111 need be made of a hard metal such as an iron-containing alloy because the platen guide must be mechanically strong enough to withstand repetitive engagement with the platen shaft. On the other hand, the support member 101 should be preferably made of a light metal such as aluminum to realize weight reduction. Thus, the platen guide must be initially separate from the support member and later fixed to the support member by the screws 113. As a result, the total number of required components increases, and a longer time is necessary for assembly. Particularly, the platen guide must be strictly adjusted in position for insuring good printing quality, so that careful mounting of the platen guide is required with resultant increase in assembling time.

Theoretically, the support member 101 may be made of an iron-containing alloy and rendered integral with the platen guide 111. However, the support member 101 is required to be rigid (namely thick enough) to minimize the previously described thermal bending of the printing head. Thus if the support member is made of such an alloy, the overall weight of the printing head increases unacceptably. In reality, therefore, the support member should be made of a light metal such as aluminum without integrating with the platen guide.

U.S. Pat. No. 4,963,886 discloses an improved thermal printing head which incorporates a head circuit board carrying a comb-like terminal portion arranged only in a limited central length which is substantially smaller than that of the head circuit board itself. Due to such an arrangement, a flexible connector board is correspondingly reduced in length, and a presser cover is made to press the connector board into contact with the comb-like terminal portion of the head circuit board only in the limited central length of the head circuit board. Thus, though a plurality of mounting screws are used to mount the presser cover onto a support member (heat sink), only those screws located within the limited central length need be tightened up in a well controlled manner. The remaining screws may be inserted loosely in diametrically larger bores of the presser cover to allow longitudinal expansion of the presser cover independently of the support member.

According to the arrangement disclosed in the above-described U.S. patent, thermal bending of the printing head can be prevented since the presser cover is allowed to expand independently of the support member except for a portion located in the limited central length of the head circuit board. Further, those of the mounting screws located outside this limited central length need not be tightened in a well controlled manner, so that the printing head can be assembled in a shorter time than the prior art printing head of FIGS. 10 and 11.

However, the printing head of the above U.S. patent still remains to be improved in the following respects.

First, the support member is rendered relatively thick to be rigid. Thus, if the support member is longitudinally board supported on the support member cannot be brought into uniform line contact with the platen, consequently resulting in deterioration of the printing quality.

It is of course possible to realize uniform line contact between the head circuit board and the platen by increasing the spring load applied to the support member because the platen rubber can elastically deform for intimate contact with the head circuit board under the increased spring load. In this case, however, a large tension must be applied to the printing paper for feeding passage between the head circuit board and the platen, thereby requiring a high-torque motor for paper feed in addition to increasing the risk of paper tearing.

Secondly, the presser cover still has a length substantially equal to that of the head circuit board in spite of the fact that the length of the flexible connector board has been greatly reduced. Indeed, the presser cover has dual functions of pressing the flexible connector board onto the head circuit board and of covering an array of drive IC's which are sensitive to external shocks. Generally, the drive IC array extends substantially over the entire length of the head circuit board, and it is for this reason that the presser cover must remain long. However, it is very beneficial for weight reduction if the length of the presser cover is reduced at least partially. It is also advantageous for simplification of assembly if the total number of required mounting screws are reduced as a result of reduction in length of the presser cover.

In the third place, the support member (heat sink) is made of a relatively thick aluminum plate. Thus, separate platen guides need be screwed to the respective ends of the support member at the time of incorporating into the printer, so that the same problem as described in connection with the prior art printing head of FIGS. 10 and 11 is inevitable.

SUMMARY OF THE INVENTION

It is, therefore, an object of the present invention to can be uniformly held into intimate contact with a platen under a normal spring load even if a support member is longitudinally curved or undulated, thereby improving the printing quality.

Another object of the present invention is to provide a components and has a reduced weight in comparison with the prior art thermal printing head A further object of the present invention is to provide a thermal printing head wherein a head circuit board can be positionally adjusted relative to a platen with ease but with high accuracy.

According to the present invention, there is provided a thermal printing head comprising: a support member; and a head circuit board supported on the support member, the head circuit board carrying a line of heating dots and an array of drive elements for driving the heating dots, the head circuit board further carrying a terminal portion for external connection; wherein the support member is elastically flexible with a modulus of elasticity lying within a range of $1\times10^4-5\times10^5$kg/mm.

The point of the present invention resides in that the support member itself is elastically flexible so that it can easily flex under a normal spring load to bring the head circuit board into uniform contact with the platen. This idea is directly opposite to the prior art wherein a platen is made to elastically deform under an increased spring load to come into uniform contact with a head circuit board which is supported on a rigid support member.

According to a preferred embodiment, the terminal portion of the head circuit board is arranged locally in a limited length which is sufficiently smaller than that of the head circuit board, the printing head further comprising: a connector board carrying a terminal portion corresponding to the terminal portion of the head circuit board, the connector board being sufficiently smaller in length than the head circuit board; and a presser member mounted on the support member for pressing the terminal portion of the connector board into intimate contact with the terminal portion of the head circuit board, the presser member having a pressing portion which is sufficiently smaller in length than the head circuit board.

The presser member may further have a covering portion arranged to cover the array of drive elements for protection. In this case, the covering portion need have a length not smaller than that of the drive element array.

Alternatively, the presser member may have no covering portion. Instead, the array of drive elements may be protected solely by being enclosed in an elongate protective body of hard resin. In this case, the presser member is arranged clear of the drive element array, and the entirety of the presser member is sufficiently smaller in length than the head circuit board. Such an arrangement contributes to further reduction in overall weight of the printing head.

According to another preferred embodiment of the present invention, each end of the support member is integrally formed with a platen guide having a guiding cutout for removably receiving a corresponding shaft end of the platen. Such an integral construction is advantageous in that the platen guide need not be subsequently attached to the support member with attendant positional adjustment and screwing Preferably, the support member may be provided with at least one marking indication located adjacent to the platen guide, the marking indication being in the form of a marking bore for example. Alternatively, the platen guide itself may be provided with at least one marking indication which may be in the form of a marking slit. In either case, the marking indication can be advantageously used for positionally adjusting the head circuit board relative to the platen guide.

Other objects, features and advantages of the present invention will be fully understood from the following detailed description of the preferred embodiments given with reference to the accompanying drawings.

DETAILED DESCRIPTION OF THE PREFERRED EMBODIMENTS

Figure 1:
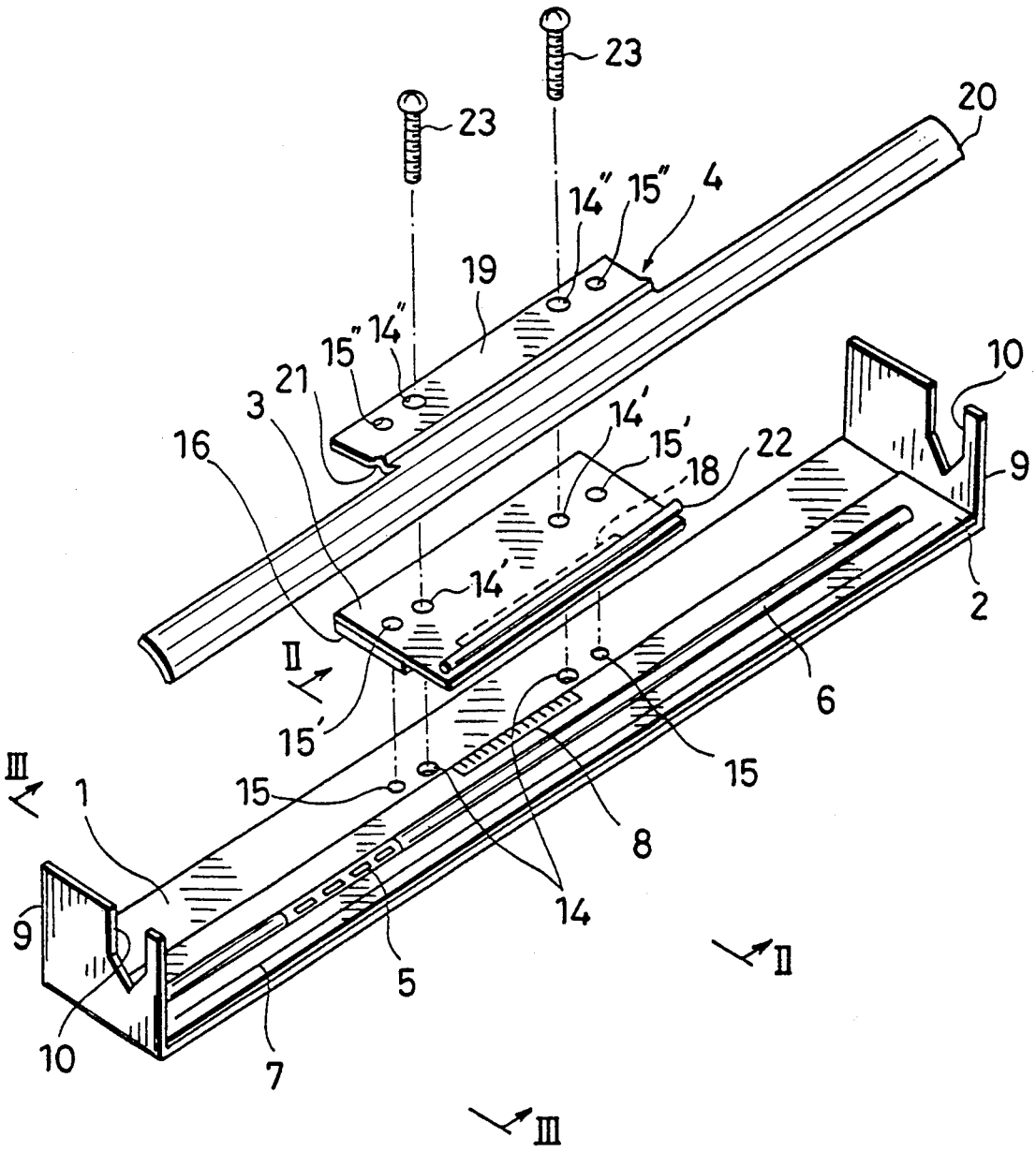
FIG. 1 is an exploded perspective view showing a thermal printing head according to the present invention.
Figure 2:
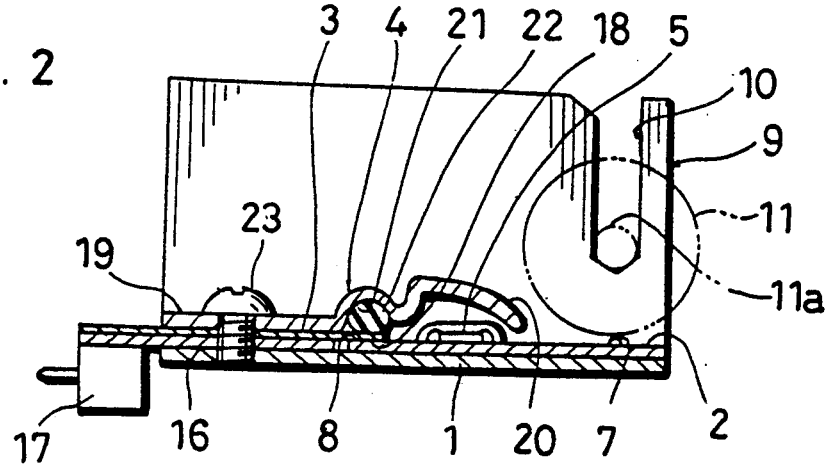
FIG. 2 is a sectional view taken along lines II—II in FIG. 1 to show the same printing head in an assembled state.
Figure 3:
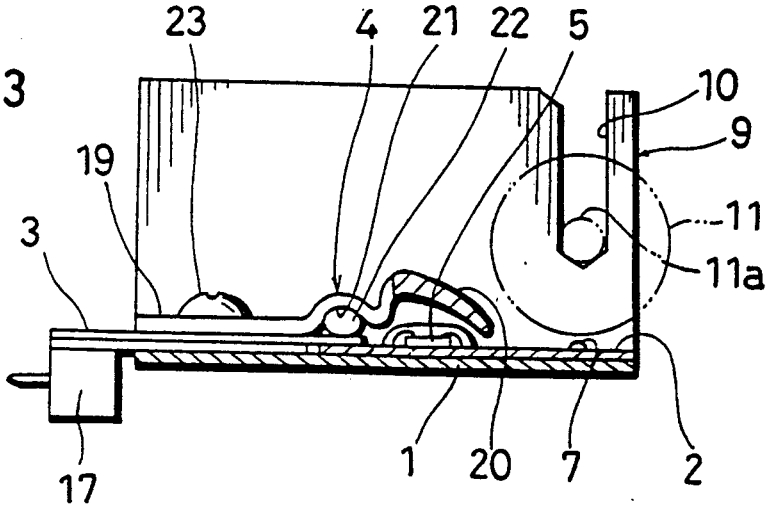
FIG. 3 is a sectional view taken along lines III—III in FIG. 1 to show the same printing head in an assembled state.

Referring first to FIGS. 1 through 3 of the accompanying drawings, there is illustrated a line-type thermal printing head which mainly includes an elongate support member 1, an elongate head circuit board 2, a flexible connector circuit board 3, and a presser member 4. The details of these main parts are described below.

The head circuit board 2 includes an insulating substrate which is made for example of a ceramic material such as alumina. The upper or front surface of the head circuit board carries drive IC's 5 enclosed in an elongate protective body 6 which is made for example of a relatively soft resin such as silicone resin, and a resistor line 7 extending along one longitudinal side of the head circuit board adjacent thereto. The resistor line 7 is divisionally driven by the drive IC's 5 for providing a line of heating dots. The front surface of the head circuit board is further formed with comb-like connection terminal portion 8 adjacent to the other longitudinal side of the head circuit board.

Though not shown in FIG. 1, the front surface of the head circuit board 2 is further formed with a conductor circuit pattern generally in the same manner as disclosed in U.S. Pat. No. 4,963,886. The unillustrated conductor pattern allows the comb-like connection terminal portion 8 to have a reduced number of terminals and to be locally arranged in a limited central portion of the head circuit board.

The support member 1, which serves also as a heat sink for the head circuit board 2, is formed by press working from a relatively thin metallic plate or sheet which is made for example of an iron-containing alloy such as steel. Each end of the support member is provided with a substantially upright platen guide 9 which is integral with the support member. The platen guide is formed with a guiding cutout 10 for receiving a corresponding shaft end 11*a* of a platen 11, as shown in FIGS. 2 and 3.

As previously described in connection with the prior art, one of the thermal printing head and the platen 11 is mounted on a fixed part of the printer, whereas the other is mounted on a pivotal part of the printer. Thus, the platen 11 can be selectively brought into and out of operative position relative to the thermal printing head by pivoting the pivotal part of the printer. The platen guide 9 of the support member 1 serves to accurately locate the platen 11 relative to the thermal printing head when the platen is brought into its operative position. Specifically, in the operative position shown in FIGS. 2 and 3, the platen 11 must come into contact with the head circuit board 2 (i.e. thermosensitive paper) along a contact line which accurately coincides with the resistor line 7 on the head circuit board.

The support member 1 is also formed with a pair of threaded bores 14 respectively at positions not concealed by the head circuit board 2. The support member is further formed with a pair of positioning bores 15 adjacent to the respective threaded bores 14. The function of these bores 14, 15 will be described later.

The flexible connector board 3 is made for example of a polyimide film and reinforced by a backing 16 which may be made of glass-fiber-reinforced epoxy resin. Since the comb-like connection terminal portion 8 of the head circuit board 2 is arranged in the limited central portion, the flexible board 3 together with the reinforcing backing 16 need only have a correspondingly reduced length. The backing 16 supports, on its underside, at least one connector 17 which may be adhesively bonded thereto.

The flexible connector board 3 has a front marginal portion projecting beyond the reinforcing backing 16. The underside of this front marginal portion is formed with a comb-like connection terminal portion 18 i n corresponding relation to the comb-like connection terminal portion 8 of the head circuit board. When assembled, the connection terminal portions 8, 18 of the head circuit board 2 and flexible connector board 3, respectively, are intimately overlapped, as described later.

The flexible connector board 3 together with the reinforcing backing 16 is provided with a pair of through-bores 14' corresponding to the threaded bores 14 of the support member 1. Further, the combined connector board and backing is provided with a pair of positioning bores 15' corresponding to the positioning bores 15 of the support member.

The presser member 4 has a pressing portion 19 and a covering portion 20. The pressing portion 19 substantially corresponds in length to the flexible connector board 3, and is overlapped thereon, as shown in FIGS. 2 and 3. On the other hand, the covering portion 20 has a length substantially corresponding to that of the elongate protective body 6, and projects beyond the flexible board 3 to fully cover the elongate protective body 6.

The underside of the pressing portion 19 is provided with an elongate recess 21 adjacent the covering portion 20 for receiving an elastic rod 22 which lies over the front marginal portion of the flexible connector board 3. Thus, when assembled, the elastic rod 22 presses the comb-like terminal portion 18 of the flexible board 3 into intimate contact with the comb-like terminal portion 8 of the head circuit board 2 to insure electric conduction therebetween.

The pressing portion 19 of the presser member 4 is also formed with a pair of through-bores 14" corresponding to the respective threaded bores 14 of the support member 1. The pressing portion is further formed with a pair of positioning bores 15" corresponding to those of the support member. Indicated at 23 are a pair of tightening screws inserted through the respective through-bores 14', 14" of the connector board 3 and pressing portion 19 into engagement with the threaded bores 14 of the support member 1.

Figure 5:
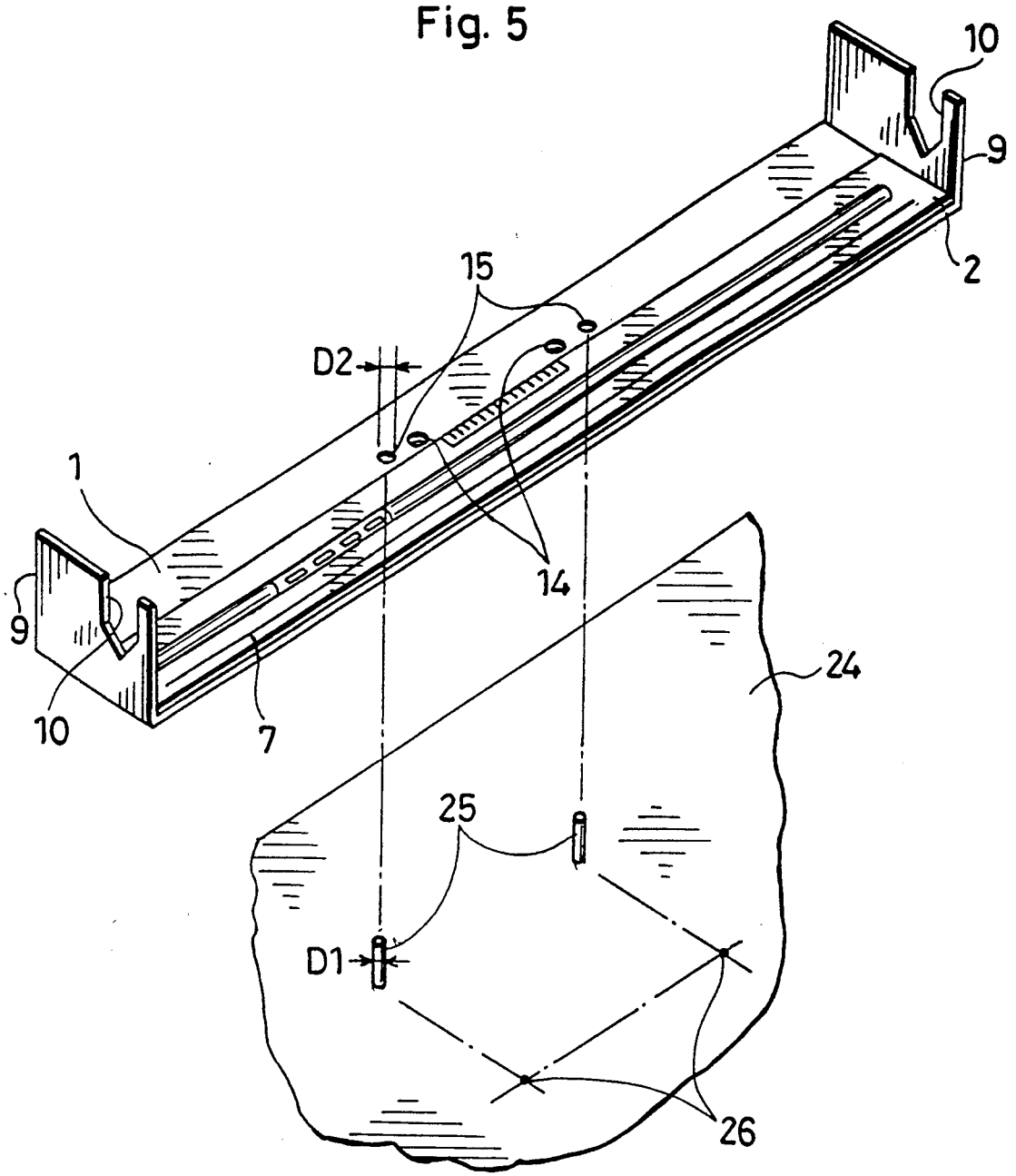
FIG. 5 is a perspective view illustrating how the printing head is assembled.

The thermal printing head described above is assembled by using an assembling apparatus incorporating a pallet 24 which is formed with a pair of positioning pins 25 and a pair of reference marks 26, as shown in FIG. 5. The positioning pins 25 and the reference marks 26 have accurate relative positions for performing accurate positional adjustment.

Specifically, in the assembling operation, the support member 1 is placed on the pallet 24 with the positioning pins 25 inserted into the respective positioning bores 15 of the support member 1. As a result, the respective guiding cutouts 10 of the platen guides 9 are positioned accurately relative to the reference marks 26 on the pallet 24.

Then, the head circuit board 2 is placed on and positionally adjusted relative to the support member 1 by utilizing the resistor line 7 of the head circuit board 2 on one hand and the reference marks 26 of the pallet 24 on the other hand. As a result, the resistor line 7 is located accurately relative to the platen 11 which is subsequently received by the guiding cutouts 10 of the support member 1.

Preferably, the head circuit board 2 is adhesively bonded to the support member 1 only in the central portion thereof. Such an arrangement is advantageous in that the support member 1 and the head circuit board 2, though having different coefficients of linear thermal expansion, can expand substantially independently of each other upon temperature increase without resulting in longitudinal bending due to the so-called "bimetal phenomenon".

After the positional adjustment and adhesive bonding of the head circuit board 2 relative to the support member 1, the flexible connector board 3 is overlapped onto the head circuit board 2, and the presser member 4 together with the elastic rod 22 is overlapped onto the connector board 3. At this time, the positioning pins 25 on the pallet 24 are inserted into the respective positioning bores 15', 15" of the connector board 3 and presser member 4, thereby accurately positioning these parts 3, 4 relative to the head circuit board.

Finally, the tightening screws 23 are inserted through the through-bores 14', 14" of the connector board 3 and presser member 4 into screw engagement with the threaded bores 14 of the support member 1 As a result, the comb-like terminal portion 18 of the connector board 3 is brought into intimate contact with the comb-like terminal portion of the head circuit board 8.

Figure 4:
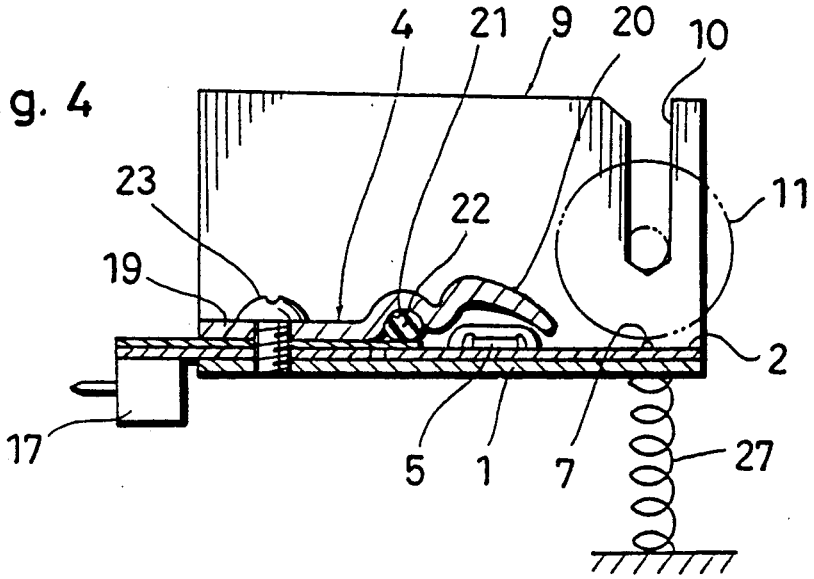
FIG. 4 is a sectional view similar to FIG. 2 but showing the same printing head as incorporated in a printer.

When incorporated into the printer, the support member 1 is pressed toward the platen 11 by springs 27, as shown in FIG. 4. Thus, the resistor line 7 on the head circuit board 2 can be brought into intimate line contact with the platen 11.

The above-described embodiment enjoys the basic advantages disclosed in U.S. Pat. No. 4,963,886 because the present invention is based on this U.S. patent. Particularly, the basic advantages include prevention of thermal bending which is obtainable from the fact that the comb-like terminal portion 8 of the head circuit board 2 is located only in the limited central portion thereof.

The embodiment shown in FIGS. 1 to 3 also has the following additional advantages.

First, while the covering portion 20 of the presser member 4 generally corresponds in length to the head circuit board 2, the pressing portion 19 of the presser member is considerably shorter than the head circuit board. Thus, the weight of the presser member can be greatly reduced in comparison with U.S. Pat. No. 4,963,886 wherein the entirety (including the pressing portion) of the presser member substantially corresponds in length to the head circuit board. More importantly, the shortened pressing portion 19 requires no fixing means near the respective ends of the covering portion 20. This makes a sharp contrast against U.S. Pat. No. 4,963,886 wherein the presser member is fixed by screws (additional to the central tightening bolts) near the respective ends of the covering portion.

Secondly, the platen guide 9 for the platen 11 is formed integrally with the support member 1. Thus, no separate platen guide need be attached to each end of the support member by screwing, and no positional adjustment is needed between the platen guide and the support member. The only necessity for accurate positioning of the platen 11 is the accurate mounting of the head circuit board 2 relative to the support member.

Therefore, it is possible to reduce the total number of required components with resultant reduction of assembling cost.

In the third place, because the comb-like terminal portion 8 of the head circuit board 2 is arranged only in the limited central portion thereof for prevention of thermal bending, the support member 1 itself need not be rigid for prevention of thermal bending. Thus, the support member 1 may be rendered relatively thin to have a reduced section modulus (i.e., rigidity), and made of an iron-containing alloy. For example, the support member 1 may be made from a steel sheet by press working. As a result, the overall weight and thickness of the thermal printing head can be greatly reduced, and the press working enables easy formation of the upright platen guides 9 by bending.

In the fourth place, because of the reduced thickness, the support member 1 can be rendered elastically flexible. Such elastic flexibility of the support member 1 may be utilized to bring the resistor line 7 into intimate contact with the platen 11 under the pressing force of the springs 27 (FIG. 4) even if the cylindricality of the platen 11 or the flatness of the support member 1 or head circuit board 2 is not strict, consequently improving the printing quality. It should be appreciated that FIG. 3 shows the resistor line 7 as slightly spaced from the platen 11, whereas FIG. 4 illustrates the resistor line as held in intimate contact with the platen.

As a result of the tests performed by the inventors, it has been found that the support member 1 should be made to have a modulus of elasticity (representative of longitudinal rigidity) lying within a range of $1\times10^4-5\times10^5$ kg/m$^2$ ($9.8\times10^4-4.9\times10^6$ N/mm$^2$). In this range, the head circuit board 2 (resistor line 7) supported on the the support member 1 can be brought into uniform line contact with the platen 11 under an overall spring load of about 3 kg for JIS A4 size paper (JIS: Japanese Industrial Standards) or 4 kg for JIS B4 size paper, thereby insuring a good printing quality.

If the modulus of elasticity is below $1\times10^4$ kg/mm$^2$, the support member 1 becomes too flexible to result in printing quality deterioration. Above $5\times10^5$ kg/mm$^2$, the support member is then too rigid, so that the head circuit board 2 on the support member cannot come into uniform line contact with the platen if the support member is longitudinally curved or undulated in its natural state.

Normally, conventional support members for thermal print heads has a modulus of elasticity lying within $-1\times10^6-1\times10^8$ kg/m$^2$ ($9.8\times10^6-9.8\times10^8$N/mm$^2$) which is ½-1/10 times as large as that of the support member of the present invention. In this conventional range for the modulus of elasticity, it is difficult to provide a uniform line contact relative to a platen roller if the support member is longitudinally curved or undulated. In this case, if a large spring load is applied in an attempt to provide uniform contact relative to the platen roller, a large pull must be applied to the printing paper, which requires the use of a high-torque motor for paper feed in addition to increasing the possibility of paper tearing.

The material for the support member 1 according to the present invention is not limitative. For instance, the support member 1 may be made of spring steel or galvanized steel. Other material is also acceptable as long as the flexibility requirement for the support member is met.

In case the support member 1 is made of galvanized steel with a thickness of 1 mm, the modulus of elasticity of the support member is $1.3\times10^5$ kg/mm$^2$ ($1.274\times10^6$ N/mm$^2$). In this case, a good printing quality is obtainable even if the support member in natural is longitudinally curved with a deviation of up to ±400 micrometers from the exact flatness at the center. By contrast, it is difficult for a conventional rigid support member to provide a good printing quality when the support member is longitudinally curved with a deviation of no less than ±100 micrometers from the exact flatness.

Figure 6:
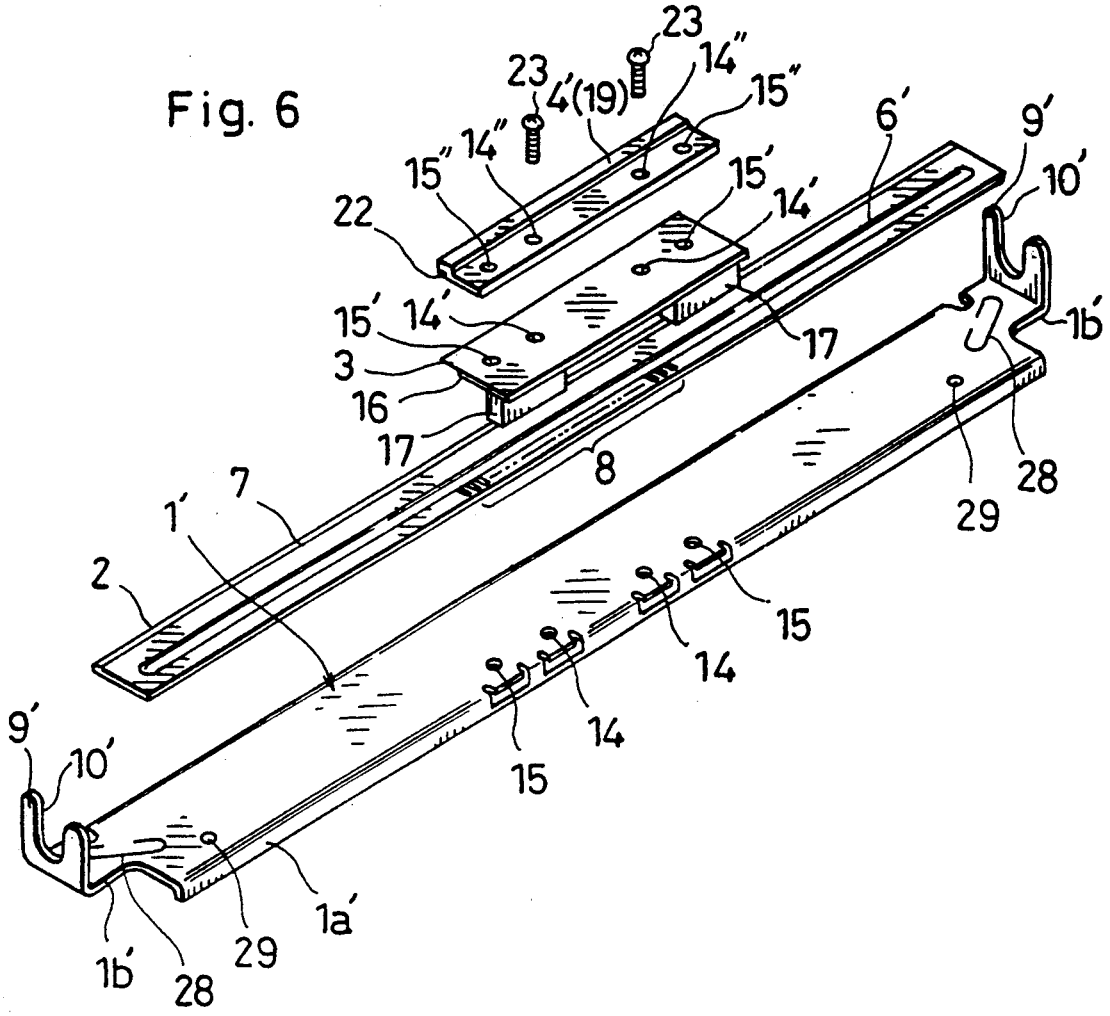
FIG. 6 is an exploded perspective view showing another thermal printing head according to the present invention.
Figure 7:
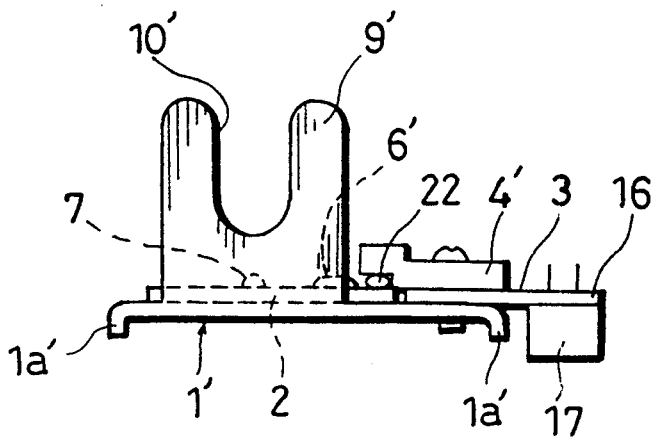
FIG. 7 is a side view showing the printing head of FIG. 6 in an assembled state.

FIGS. 6 and 7 show another thermal printing head according to the present invention. This printing head is similar to the foregoing embodiment but differs therefrom in several respects.

The printing head of FIGS. 6 and 7 includes a support member 1' which is formed for example from a steel sheet by press working. The support member 1' is integrally formed, along the respective longitudinal edges, with downturned flanges 1a' for reinforcement. Indeed, the support member 1' need be reasonably flexible but reasonably rigid, and the height of each flange may be determined by various requirements (e.g. wall thickness of the support member). If the support member is too flexible, an increased number of springs (see FIG. 4) will be necessary to insure intimate contact between the head circuit board 7 and the platen (see FIGS. 2–4) along the entire length of the printing head. Thus, the provision of the flanges 1a' is significant in that the flexibility (or rigidity) of the support member can be suitably adjusted by adjusting the height of the flanges.

The support member 1' also has a pair of narrower end portions 1b' which are mechanically reinforced by depressions 28. Each end portion 1b' is formed with an upright platen guide 9' having a guiding cutout 10'. The support member is further provided with a pair of marking bores 29 located adjacent the respective platen guides 9' for use as reference marks in positionally adjusting the head circuit board 2 relative to the support member, as described hereinafter.

The diameter of each marking bore 29 may be optionally selected but preferably no more than 1 mm (e.g. about 0.5 mm) to provide accurate positional adjustment. Obviously, the marking bore must be located offset toward one longitudinal edge of the support member 1 so that the marking bore will not be concealed by the head circuit board 2 attached to the support member.

The head circuit board 2 shown in FIGS. 6 and 7 differs from that of the foregoing embodiment only in one respect. Specifically, an array of drive IC's (not shown in FIGS. 6 and 7 but shown in FIG. 1) are enclosed in an elongate protective body 6' which is made of hard resin instead of soft resin (e.g. silicone resin). A preferable example of hard resin is polyetheramide resin, but other hard resin may be acceptable. Due to the use of hard resin, the protective resinous body 6' alone can fully protect the enclosed drive IC's against external shocks, thus making it unnecessary to provide additional protection.

The presser member 4' illustrated in FIGS. 6 and 7 has no covering portion for the drive IC's because the hard protective body 6' alone can provide sufficient protection. Thus, the presser member may be greatly reduced in weight, and the entirety of the presser member is used solely for pressing the flexible connector board 3 into intimate contact with the head circuit board 2.

According to the foregoing embodiment (see FIG. 5), the positional adjustment between the support member 1 and the head circuit board 2 is performed by utilizing the positioning pins 25 and reference marks 26 on the pallet 24. This manner of positional adjustment can be accurate only when the pins 25 are intimately fitted in the positioning bores 15 of the support member since otherwise the support member may deviate slightly relative to the reference marks 26. However, the diameter D1 of the pins 25 must be slightly smaller than the diameter D2 of the positioning bores 15 to enable their mutual fitting. Thus, the pins 25 and the positioning bores 15 must be machined with an extremely high precision to minimize the diametrical tolerance (D2−D1) for accurate positional adjustment. This strict requirement results in production cost increase. Further, the strict diametrical tolerance (namely close fit) between the pins 25 and the positioning bores 15 makes it difficult to quickly fit and separate them, thus leading to great slowdown in the production process.

According to the embodiment of FIGS. 6 and 7, use is made of the marking bores 29 which are directly formed on the support member 1' in predetermined positonal relation to the platen guides 9 for positionally adjusting the head circuit board 2 relative to the support member. Specifically, the support member is placed on the pallet 24 (see FIG. 5) by inserting the positioning pins 25 into the positioning bores 15 of the support member, and the head circuit board 2 is positionally adjusted by referring to the resistor line 7 of the head circuit board on one hand and the marking bores 29 of the support member on the other hand.

Obviously, during the positional adjustment, the positioning pins 25 of the pallet 24 may be loosely fitted in the positioning bores 15 of the support member 1' because the positional relation between the marking bores 29 and the platen guides 9 is fixed regardless of movement of the support member 1' relative to the pallet 24. Thus, the positional adjustment becomes more reliable and accurate. The reference marks 26 of the pallet 24 are no longer used for positional adjustment, so that these marks may be omitted for simplification of the pallet.

It should be appreciated that the marking bores 29 may be formed simultaneously with press-formation of the support member 1' itself. Thus, the provision of these bores does not result in any cost increase. Further, since the function of the marking bores 29 is to provide reference points for positional adjustment, these bores may be replaced by any other marks such as marking projections and marking depressions.

Figure 8:
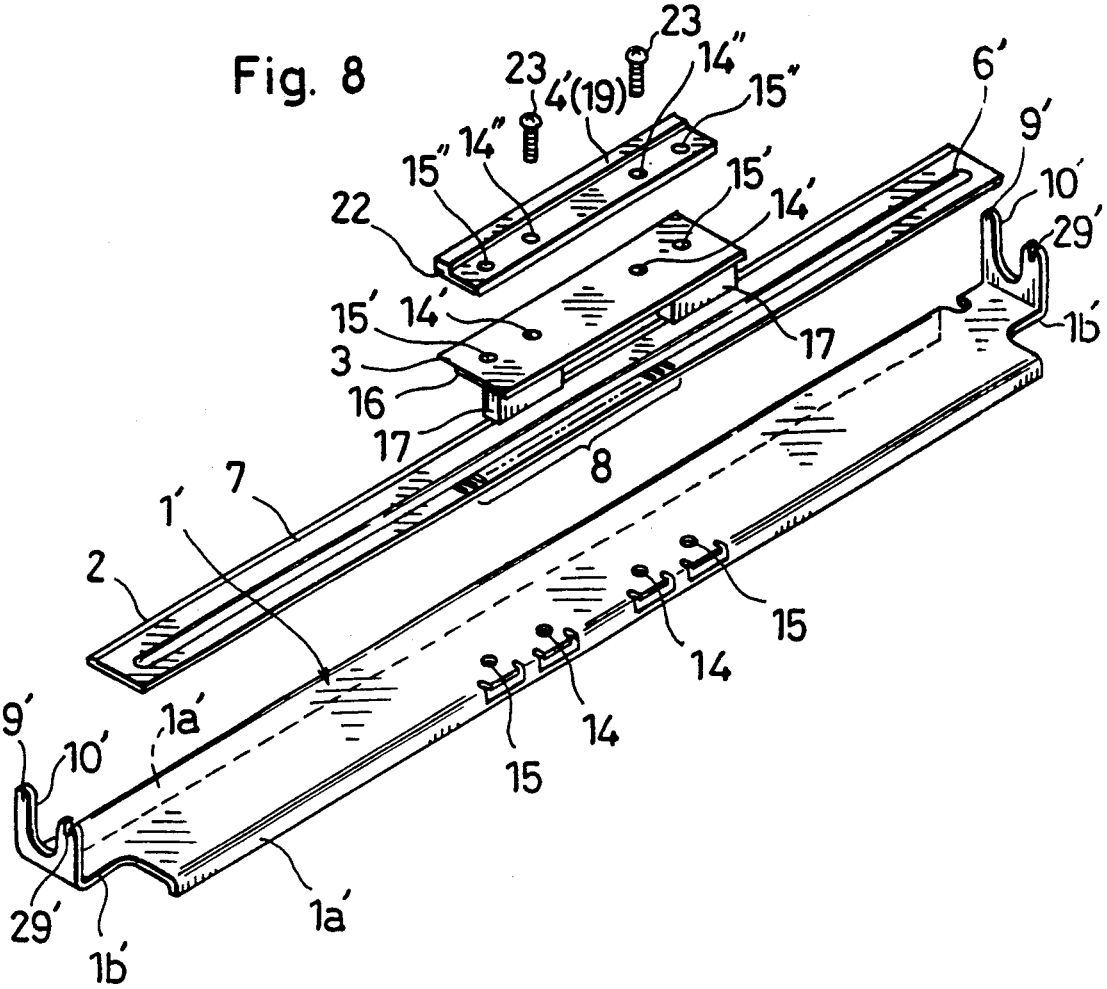
FIG. 8 is an exploded perspective view showing a further thermal printing head according to the present invention.
Figure 9:
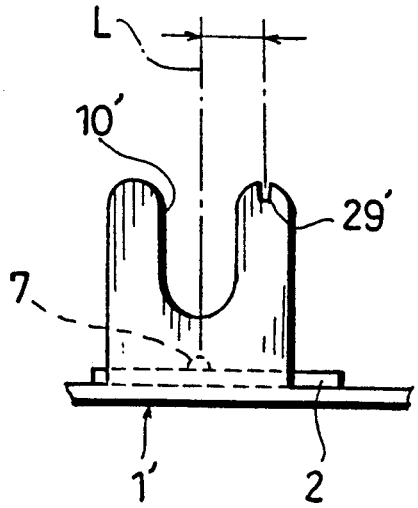
FIG. 9 is a side view showing the printing head of FIG. 8 in an assembled state.
Figure 10:
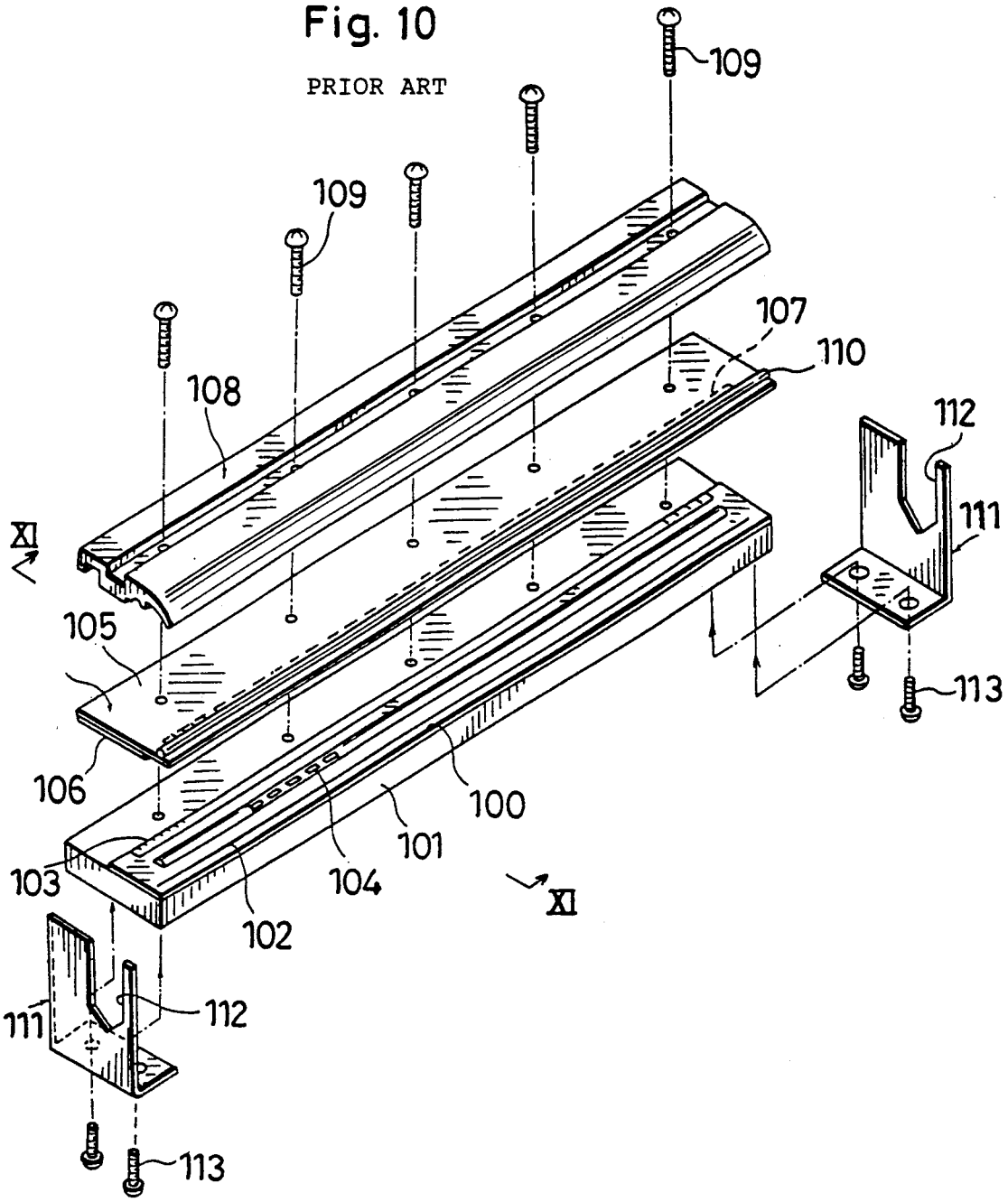
Fig. 10 PRIOR ART
FIG. 10 is an exploded perspective view showing a prior art thermal printing head.
Figure 11:
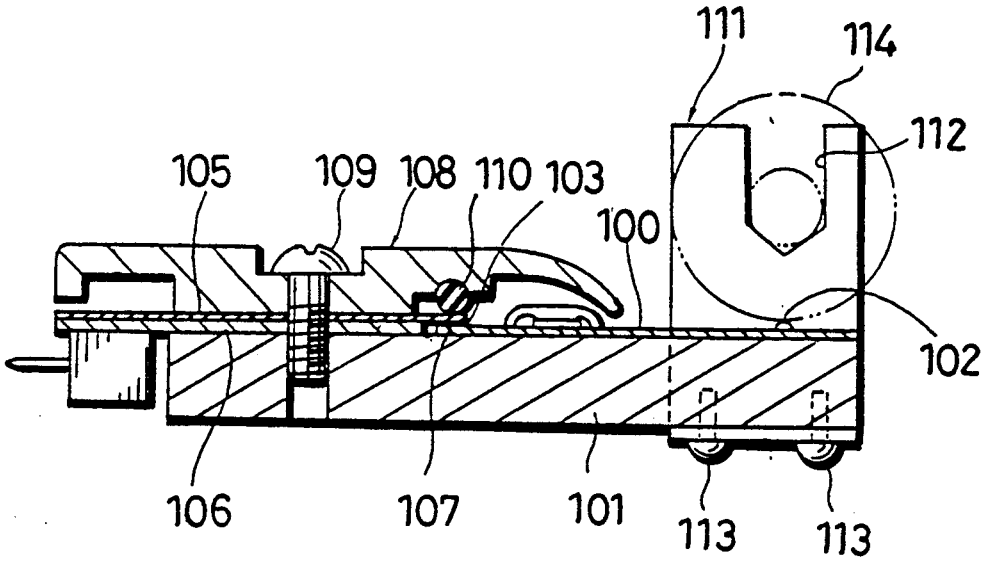
Fig. 11 PRIOR ART
FIG. 11 is a sectional view taken along lines XI—XI in FIG. 10 to show the prior art printing head in an assembled state.

FIGS. 8 and 9 show a slight modification which differs from the embodiment of FIGS. 6 and 7 only in one point. Specifically, the support member 1' of the modified printing head is formed with a pair of marking slits 29' respectively located at the platen guides 9' near the guiding cutouts 10'.

As previously described, the positional adjustment between the support member 1' and the head circuit board 2 is necessary to bring the platen 11 (see FIG. 2) into intimate line contact with the resistor line 7 of the head circuit board. For this purpose, a central line L (FIG. 7) passing through the guiding cutout 10' of each platen guide 9' must be made to coincide with the resistor line 7. Obviously, the reference or standard point should be located as close to the central line L as possible in order to increase the accuracy of positional adjustment.

According to the embodiment of FIGS. 6 and 7, each marking bore 15 is disposed comparatively remote from the corresponding guiding cutout 9' transversely of the support member 2'. On the other hand, each marking slit 29' of FIGS. 8 and 9 is located much closer to the corresponding guiding cutout 9', thereby serving as a better reference point for accurate positional adjustment.

Further, according to the arrangement of FIGS. 8 and 9, even if each platen guide 9' is improperly bent, the positional relation between the guiding cutout 10' and the marking slit 29' is invariable because the marking slit is formed directly on the platen guide. Thus, the marking slit 29' always serves as an accurate reference point relative to the cutout central line L. According the embodiment of FIGS. 6 and 7, the positional relation between the guiding cutout 10' and the marking bore 29 varies when the platen guide 9' is improperly bent, thus failing to provide an accurate reference point.

The width of the marking slit 29' may be optionally selected but preferably no more than 1 mm (e.g. 0.5 mm). Of course, the marking slit may be replaced by any other indications which include a marking projection.

The present invention being thus described, it is obvious that the same may be varied in many ways. Such variations are not to be regarded as a departure from the spirit and scope of the invention, and all such modifications as would be obvious to those skilled in the art are intended to be included within the scope of the following claims.

We claim:

1. A thermal printing head comprising:

a support member, and a head circuit board supported on the support member, the heat circuit board carrying a line of heating dots and an array of drive elements for driving the heating dots, the head circuit board further carrying a terminal portion for external connection, wherein the support member has a modulus of elasticity lying within a range of $1\times10^4-5\times10^5$ kg/mm$^2$, the support member being allowed to flex elastically even after assembly thereof, wherein the terminal portion of the head circuit board is arranged locally in a limited length which is sufficiently smaller than that of the head circuit board, the printing head further comprising:

a connector board carrying a terminal portion corresponding to the terminal portion of the head circuit board, the connector board being sufficiently smaller in length than the head circuit board, and a presser member mounted on the support member for pressing the terminal portion of the connector board into intimate contact with the terminal portion of the head circuit board, the presser member having a pressing portion which is sufficiently smaller in length than the head circuit board, wherein the array of drive elements is enclosed in an elongate protective body of hard resin, the presser member being arranged clear of the drive element array, the entirety of the presser member being sufficiently smaller in length than the head circuit board.

2. A thermal printing head comprising:

a support member, and a head circuit board supported on the support member, the head circuit board carrying a line of heating dots and an array of drive elements for driving the heating dots, the head circuit board further carrying a terminal portion for external connection, wherein the support member has a modulus of elasticity lying within a range of $1\times10^4-5\times10^5$ kg/mm$^2$, the support member being allowed to flex elastically even after assembly thereof, wherein each end of the support member is provided with a platen guide having a guiding cutout for removably receiving a corresponding shaft end of a platen, wherein said each end of the support member is formed with at least one reinforcing depression adjacent to the platen guide.

3. A thermal printing head comprising:

a support member, and a heat circuit board supported on the support member, the head circuit board carrying a line of heating dots and an array of drive elements for driving the heating dots, the head circuit board further carrying a terminal portion for external connection, wherein the support member has a modulus of elasticity lying within a range of $1\times10^4-5\times10^5$ kg/mm$^2$, the support member being allowed to flex elastically even after assembly thereof.

wherein each end of the support member is provided with a platen guide having a guiding cutout for removably receiving a corresponding shaft end of a platen, wherein the support member is provided with at least one marking indication located adjacent to the platen guide.

4. The printing head according to claim 3, wherein the marking indication is a marking bore formed in the support member.

5. A thermal printing head comprising:

a support member, and a head circuit board supported on the support member, the head circuit board carrying a line of heating dots and an array of drive elements for driving the heating dots, the head circuit board further carrying a terminal portion for external connection, wherein the support member has a modulus of elasticity lying within a range of $1\times10^4-5\times10^5$ kg/cm$^2$, the support member being allowed to flex elastically even after assembly thereof, wherein each end of the support member is provided with a platen guide having a guiding cutout for removably receiving a corresponding shaft end of a platen, wherein the platen guide is provided with at least one marking indication.

6. The thermal printing head according to claim 5, wherein the marking indication is a marking slit formed at the platen guide.

7. A thermal printing head comprising:

a support member, and a head circuit board supported on the support member, the head circuit board carrying a line of heating dots and an array of drive elements for driving the heating dots, the head circuit board further carrying a terminal portion for external connection, wherein the support member has a modulus of elasticity lying within a range of $1\times10^4-5\times10^5$ kg/mm$^2$, the support member being allowed to flex elastically even after assembly thereof.

wherein the support member is integrally formed with a pair of longitudinal flanges directed away from the head circuit board.

8. The printing head according to claim 7, wherein each end of the support member is provided with a platen guide having a guiding cutout for removably receiving a corresponding shaft end of a platen.

9. The printing head according to claim 8, wherein the platen guide is integrally formed with said each end of the support member.

* * * * *